United States Patent [19]

Rusth et al.

[11] 4,185,545

[45] Jan. 29, 1980

[54] AIR CIRCULATOR

[76] Inventors: Douglas B. Rusth, 1335 SW. 66th Ave., Apt. 404, Portland, Oreg. 97225; David A. Martin, 14025 SW. Bonny Brae Ct., Beaverton, Oreg. 97005

[21] Appl. No.: 921,731

[22] Filed: Jul. 3, 1978

Related U.S. Application Data

[63] Continuation-in-part of Ser. No. 757,898, Jan. 10, 1977, abandoned.

[51] Int. Cl.[2] ..... F24F 13/06

[52] U.S. Cl. ..... 98/33 A; 98/40 C; 417/361

[58] Field of Search ..... 98/29, 33 A, 115 R, 98/115 VM, 40 C, 39; 62/419; 138/107; 417/361; 248/317

[56] References Cited

U.S. PATENT DOCUMENTS

| | | | |
|---|---|---|---|
| 1,924,489 | 8/1933 | Ferris | 98/39 X |
| 1,997,181 | 4/1935 | Lyon | 98/39 |
| 2,156,831 | 5/1939 | Andre | 248/317 X |

FOREIGN PATENT DOCUMENTS

| | | | |
|---|---|---|---|
| 2296818 | 12/1974 | France | 98/33 A |

*Primary Examiner*—William E. Wayner
*Attorney, Agent, or Firm*—James D. Givnan, Jr.

[57] ABSTRACT

An air circulating device for suspension from a roof or ceiling structure and including a duct through which upper room air may be directed for discharge into lower temperature air immediately above the room floor. A support structure houses a fan and motor assembly and a collar to receive the duct upper end. The inflatable duct is of a yieldable nature and terminates in spaced relationship to the floor. Provision is made for mixing lower room air with the duct airflow and for the imparting of a rotational direction to the duct discharged airflow.

6 Claims, 11 Drawing Figures

AIR CIRCULATOR

BACKGROUND OF THE INVENTION

The present application is a continuation-in-part of our copending U.S. patent application bearing the same title, filed Jan. 10, 1977 under Ser. No. 757,898, now abandoned.

The present invention relates generally to that class of devices for generating a circulatory flow of air within a building structure or room and particularly to such a device having an upright air duct.

Warmer air naturally rises towards the ceiling resulting in thermal stratification of room air with higher air temperatures occurring in the upper area of a room while the lower area, the habitable space of the room, is several degrees cooler. The temperature differential depends on a variety of factors. Accordingly, fuel consumption may be reduced if the warmer, upper room air is circulated to mix with the colder, lower room air. Additionally, heat loss through the ceiling or roof is directly proportional to the temperature of upper room air.

This problem has been recognized and various solutions proposed as seen, by way of example, in U.S. Pat. Nos. 1,170,551; 3,173,353; D 89,212 and D 239,940. Common to such efforts is a rigid duct structure with some including a fan and motor assembly located adjacent a supporting floor surface for drawing an airflow downwardly through the duct to promote mixing of room air and thereby reduce the vertical temperature gradient. While some of these embodiments are entirely functional they are best suited for use in specific environments, most commonly, the home where room height is approximately eight or nine feet.

SUMMARY OF THE PRESENT INVENTION

The present invention is embodied in an air circulator having a depending duct and adapted for suspension from a ceiling or roof structure of a home or building.

The suspended duct is of a yieldable nature and serves to discharge warm air downwardly into normally the lowest temperature strata of a room i.e., that area immediately above the floor. The colder dense air at floor level is accordingly infused with warmer air from the ceiling area with the volume and temperature of "floor" air thereby increased resulting in an unstable condition and upward currents of slightly warmed air. Such air circulation significantly reduces the temperature gradients between floor and ceiling air layers and permits the habitable area of a building to benefit from dormant, higher temperature air normally collecting subjacent the ceiling.

An important advantage of the suspended duct, particularly in industrial buildings, is the continued utilization of room space which is not the case with stationary floor mounted air circulators. The yieldable duct is not susceptible to damage by accidental physical contact and, conveniently may be of any length desired.

A support structure of the present air circulator is adapted for suspension from a ceiling or roof member and provides a base for a fan and motor assembly. The fan component discharges an airflow for passage along said duct for draft free discharge superjacent the floor level.

A modified form of the air circulator includes air mixing means disposed adjacent the duct lower end and serves to induce the entry of room air into the duct to provide both circulatory and volumetric benefits. A duct restriction, adjacent the duct lower end, assures proper duct inflation against atmospheric pressure. Air dispersal means at the duct lower end enhances room circulation.

Important objectives of the present air circulator include: the provision of a circulator having a suspended duct which is free to move in response to being contacted; the provision of an air circulator adapted for suspension from a ceiling or roof member enabling extremely low cost, convenient installation and with a pliable duct readily adaptable to various ceiling to floor distances; the provision of an air circulator having a fan and motor assembly located at the elevated intake end of a duct resulting in an efficient airflow; the provision of an air circulator having a fan disposed interiorly of a duct member for maximum CFM; the provision of an air mixing ring drawing room air into a lower portion of the duct to add to duct volume; the provision of air restriction means to assure duct inflation; the provision of air dispersal means at the duct end to supplement the Coriolis effect and assure optimum dispersal.

DETAILED DESCRIPTION OF THE PREFERRED EMBODIMENTS

Figure 1:
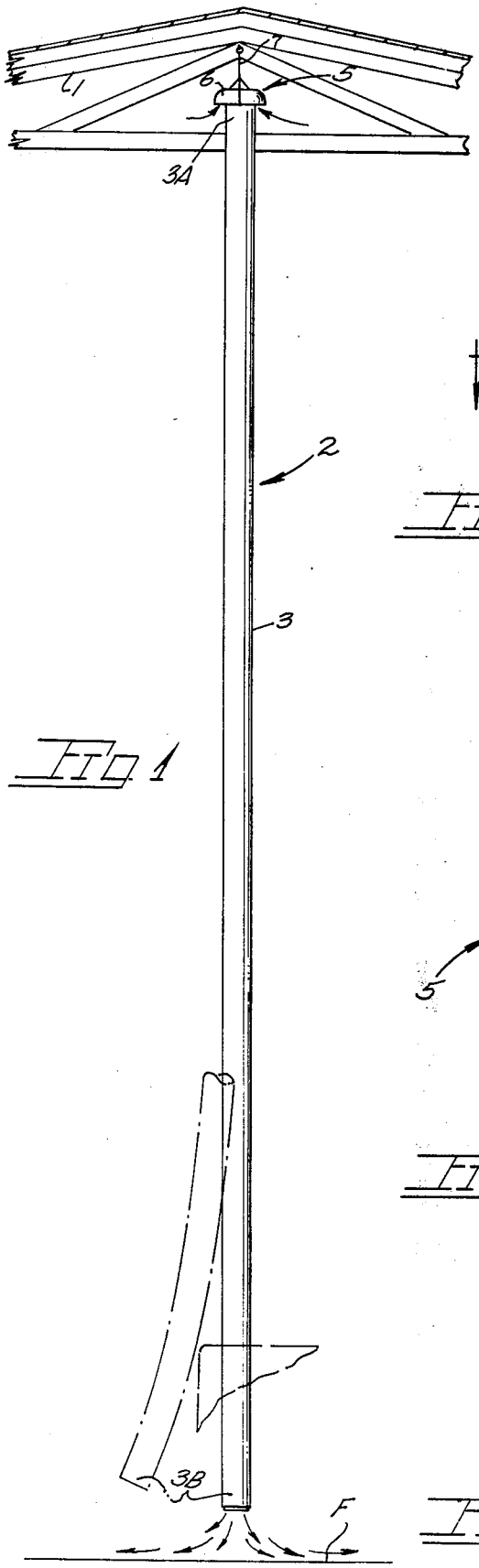
FIG. 1 is a side elevational view of the present air circulator operatively disposed within a building structure.
Figure 5:
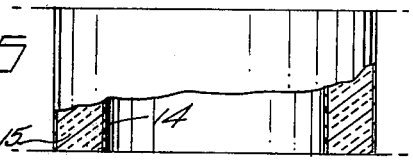
FIG. 5 is an elevational view of a segment of a modified duct.
Figure 2:
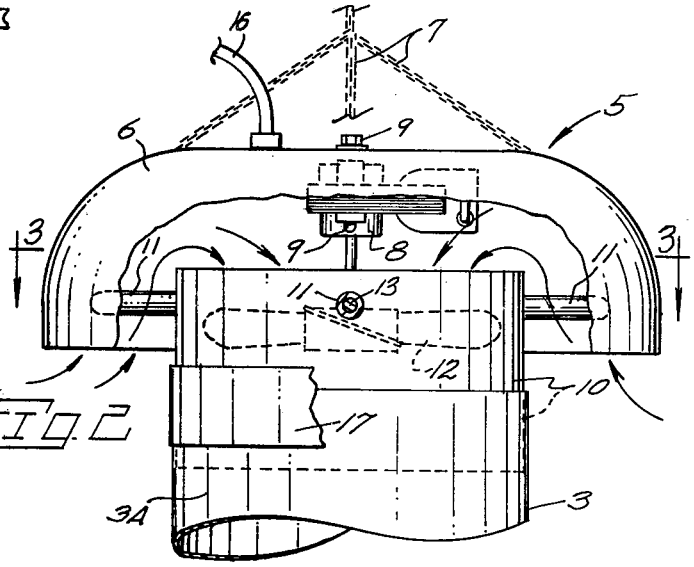
FIG. 2 is an enlarged elevational view of the upper end of the air circulator with fragments broken away for purposes of illustration.
Figure 3:
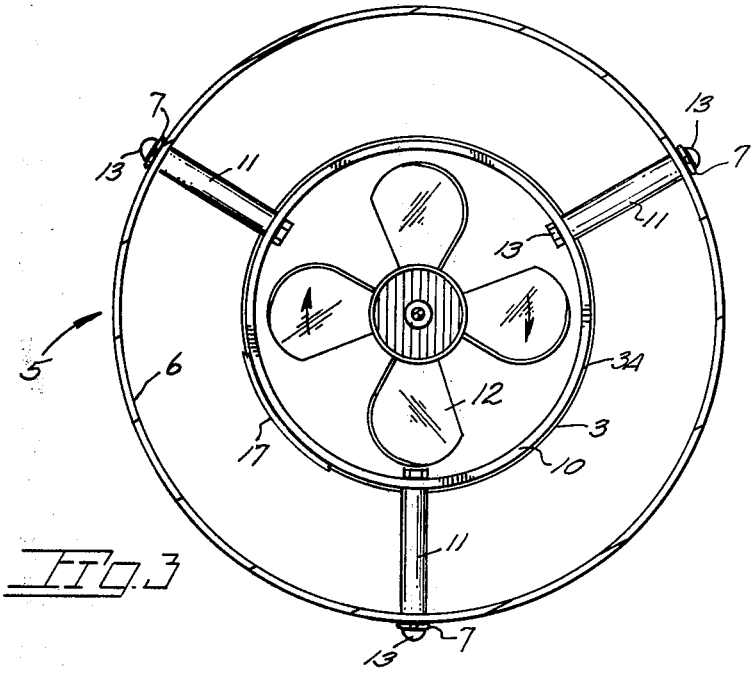
FIG. 3 is a horizontal section taken generally along line 3—3 of FIG. 2.
Figure 4:
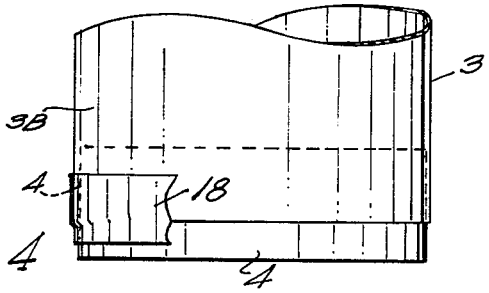
FIG. 4 is an elevational view of the lower end of the air circulator duct.

With continuing reference to the accompanying drawing wherein applied reference numerals indicate parts similarly identified in the following specification, the reference numeral 1 indicates a building roof structure from which the present circulator may be suspended. The term roof structure is, for present purposes, synonomous with ceiling as both define generally the upper limit of a room or building space.

The present air circulator is indicated generally at 2 and includes a duct 3 which serves to direct an airflow into that area of a room immediately above a floor surface F. Duct 3 is preferably of a length so as to have its upper and lower ends at 3A and 3B offset approximately one foot from adjacent roof and floor surfaces to assure optimum air circulation. Obviously duct length may be readily altered to suit the specific height of the room or building structure. In a preferred embodiment, duct 3 is of heavy duty, tubular plastic film of a suitable gauge collapsible upon momentary impact. Disposed within the duct is flow restriction means in the form of a rigid collar member 4 which provides desired mass to the duct lower end as well as imparting a circular shape to the duct by reason of constituting an airflow restriction for duct inflation. In some installations, a rigid duct may be entirely satisfactory.

Indicated generally at 5 is a support structure of the air circulator including a base 6 which may be of molded, dome-like construction. Bridle type hanger means at 7 enables convenient, horizontal suspension of base 6 from a single roof or ceiling attachment point. Accordingly, the entire air circulator may move in pendulum fashion about the uppermost, single chain member if accidentally contacted by a person or moving equipment. Mounted on base 6 is a motor fan assembly at 8 secured by a pair of fastener assemblies, as at 9, extending upwardly through said base. The support structure includes mounting means in the form of a partially enclosed collar 10 with spacers at 11 serving to locate the collar in coaxial relationship about a fan blade 12 and inwardly offset from the lowermost portion of base 6. Duct 3 is suitably attached to collar 10 as by a strip of pressure sensitive tape 17. Fasteners 13 serve to retain the spacers and collar in place and additionally to attach the attachment chains 7 to base 6. A power supply cord is indicated at 16.

A modified duct at 14 includes an outer layer of insulation at 15 which inhibits radiant heat loss from the duct and is particulary desirable where radical ceiling-floor temperature gradients exist.

The operation of the air circulator is believed readily apparent from the foregoing description. The duct length may be altered simply by cutting same to provide the desired spacing from ceiling and floor surfaces with collar 4 being reinstalled in the duct lower end with an adhesive or tape as at 18.

Figure 6:
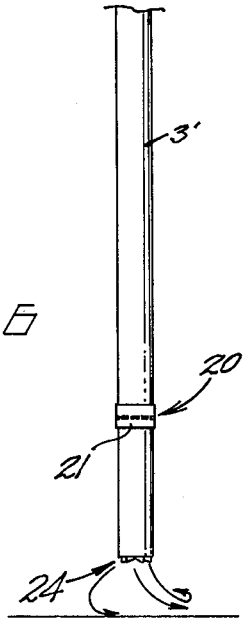
FIG. 6 is a side elevational, fragmentary view of the duct of a modified air circulator.
Figure 7:
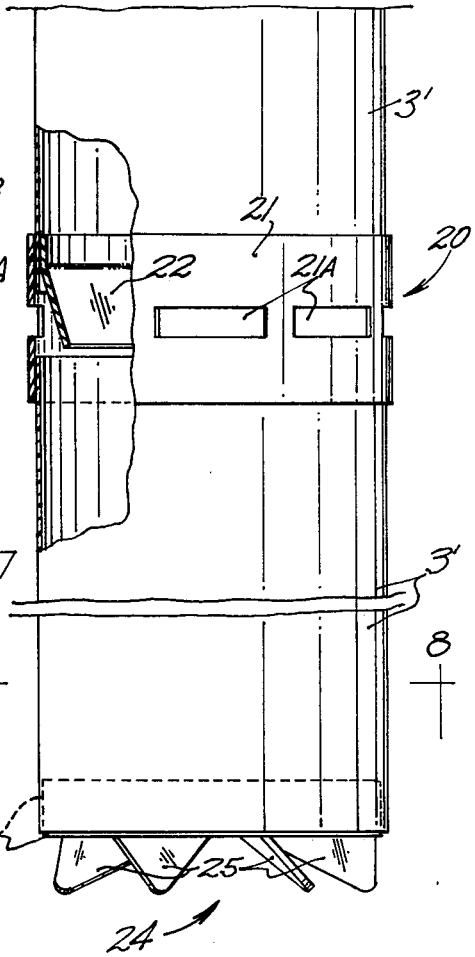
FIG. 7 is a view similar to FIG. 6 but on an enlarged scale.
Figure 8:
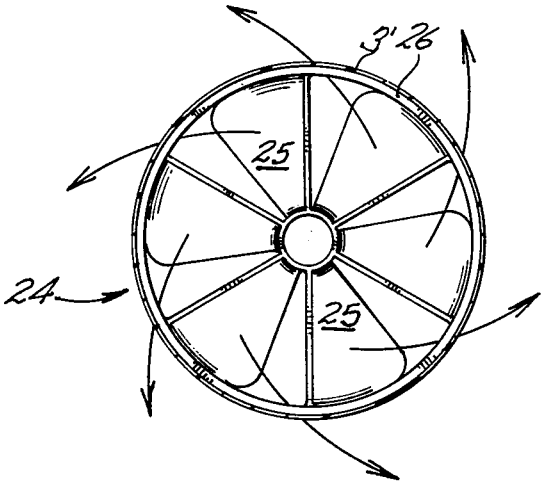
FIG. 8 is a bottom plan view of FIG. 7.

In FIGS. 6 through 8 a modified form of the air circulator is disclosed including air mixing means indicated. generally at 20 for combining room air with the airflow through duct 3'. A ring 21 defines circumferentially spaced openings 21A through which room air is drawn. The ring is located along the modified duct below the duct midpoint and preferably about two feet or so from the duct end. To assure an inward flow of room air through openings 21A, an annular low pressure area is formed inwardly of the openings by flow restriction means shown as a truncated conical collar 22 suitably secured in place as by a friction fit with the duct end and the ring inner wall surface.

Importantly truncated collar 22 also serves to assure duct inflation by causing upstream duct pressure to at all time exceed atmospheric pressure which may otherwise distort the duct from a circular section.

Room air drawn through ring openings 21A mixes with duct air to increase downstream duct airflow volume. Room air circulation in the immediate area of duct 3' is accordingly benefitted.

Airflow dispersal means, generally at 24, includes blades 25 imparting a rotational component or swirling motion to duct discharged air for the purpose of enhancing air dispersal. The air is directed counter clockwise by the passage of same past the fixed blades which are inclined to the duct axis. Said blades extend below a blade rim 26 which serves to exteriorly receive the duct end by suitable means such as an adhesive.

In the Northern Hemisphere, Coriolis force acts on moving fluids to impart a counter clockwise motion to same. The present dispersal means serves to contribute to Coriolis force by imparting a counter clockwise component or swirl to duct discharged air.

Figure 9:
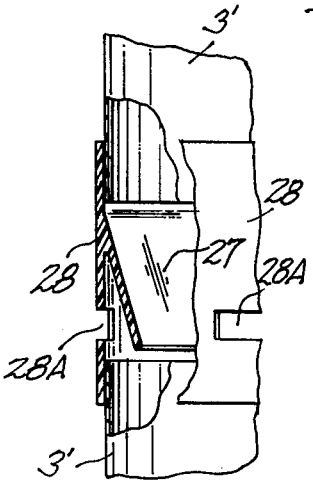
FIG. 9 is a fragmentary, side elevational view of modified air mixing means.

In FIG. 9 the flow restriction means is shown as a collar 27 formed integral with a ring 28 having air inlet openings 28A.

Figure 10:
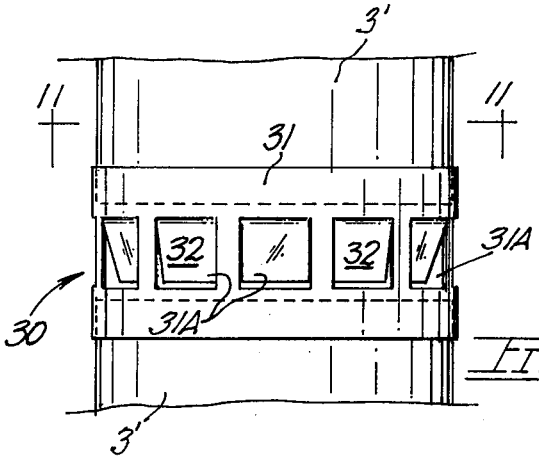
FIG. 10 is still another side elevational view of modified air mixing means.
Figure 11:
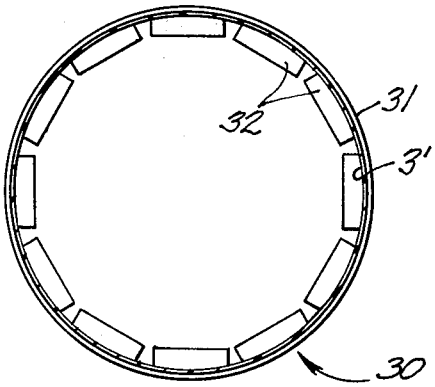
FIG. 11 is a horizontal sectional view taken downwardly along line 11—11 of FIG. 10.

Modified air mixing means is indicated generally at 30 in FIGS. 10 and 11 and comprises a ring 31 suitably secured adjacent its upper and lower edges to segments of an air flow duct 3'. Openings at 31A receive room air induced by a low pressure area interiorly of the ring resulting from flow restriction means in the form of inwardly inclined tabs 32. Said tabs additionally serve to assure upstream duct pressure being above atmospheric pressure to prevent duct deformation.

While we have shown but a few embodiments of the invention it will be apparent to those skilled in the art that the invention may be embodied still otherwise without departing from the spirit and scope of the invention claimed.

Having thus described the invention what is desired to be secured under a Letters Patent is:

1. An air circulator for circulating heated convective air for attachment to a roof or ceiling structure of a room, said air circulator comprising, a duct formed from a pliable film material suspended from its upper end and discharging an airflow towards the floor area of the room, a fan and motor assembly, a support structure including a dome shaped base to which said fan and motor assembly is attached, hanger means suspending the support structure from an overhead structure, said support structure additionally including mounting means partially enclosed by said base and to which the upper end of said duct is attached whereby the duct is in axial relationship with the fan of the fan and motor assembly, said base having a lowermost outer portion outwardly offset from said mounting means and the upper end of said duct, said base receiving a fan induced flow of heated convective air from that area of the room subjacent the roof or ceiling structure for subsequent downward flow into the duct upper end and passage via said duct and discharge into an area superjacent the floor of the room to heat the latter area, and flow restriction means within the lower portion of said duct for duct inflation.

2. The air circulator claimed in claim 1 wherein said hanger means is of a non-rigid, bridle type having a single chain member permitting momentary pendulous displacement of said support structure upon impact of an article with the air circulator.

3. The air circulator claimed in claim 1 additionally including air mixing means in place along said duct below the duct midpoint and including a ring defining circumferentially spaced openings, said flow restriction means comprising a collar disposed interiorly of said ring forming a zone of below atmospheric pressure inwardly of said ring openings to induce a flow of room air into said duct via the ring openings to increase downstream duct volume.

4. The air circulator claimed in claim 3 wherein said collar is of truncated conical shape.

5. The air circulator claimed in claim 4 wherein said collar is integral with said ring.

6. The air circulator claimed in claim 3 additionally including dispersal means at the lowermost end of said duct having blades in offset inclined relationship to the duct axis so as to impart a rotational component to the duct discharged airflow to supplement the Coriolis effect and enhance air dispersal.

* * * * *